US009297521B2

(12) United States Patent
Zhou

(10) Patent No.: US 9,297,521 B2
(45) Date of Patent: Mar. 29, 2016

(54) FOCUSING STRUCTURE FOR LED LAMP HAVING A LENS ASSEMBLY ROTATABLY ENGAGED TO A MAIN BODY

(71) Applicant: MAINHOUSE (XIAMEN) ELECTRONICS CO., LTD, Xiamen (CN)

(72) Inventor: Nanqing Zhou, Xiamen (CN)

(73) Assignee: MAINHOUSE (XIAMEN) ELECTRONICS CO., LTD., Xiamen, Fujian (CN)

( * ) Notice: Subject to any disclaimer, the term of this patent is extended or adjusted under 35 U.S.C. 154(b) by 0 days.

(21) Appl. No.: 14/357,797

(22) PCT Filed: Nov. 16, 2012

(86) PCT No.: PCT/CN2012/084735
§ 371 (c)(1),
(2) Date: May 13, 2014

(87) PCT Pub. No.: WO2014/048018
PCT Pub. Date: Apr. 3, 2014

(65) Prior Publication Data

US 2014/0334161 A1 Nov. 13, 2014

(30) Foreign Application Priority Data

Sep. 29, 2012 (CN) ..... 2012 1 0372534

(51) Int. Cl.

| | |
|---|---|
| ***F21V 17/02*** | (2006.01) |
| ***F21V 5/00*** | (2015.01) |
| ***F21V 14/06*** | (2006.01) |
| *F21K 99/00* | (2010.01) |
| *F21Y 101/02* | (2006.01) |
| *F21Y 105/00* | (2006.01) |

(52) U.S. Cl.
CPC ..... *F21V 17/02* (2013.01); *F21V 5/007* (2013.01); *F21V 14/06* (2013.01); *F21K 9/137* (2013.01); *F21Y 2101/02* (2013.01); *F21Y 2105/001* (2013.01)

(58) Field of Classification Search
CPC ..... F21V 5/007; F21V 17/02; F21V 14/06; F21V 14/065; F21Y 2101/02
See application file for complete search history.

(56) References Cited

U.S. PATENT DOCUMENTS

| | | | | |
|---|---|---|---|---|
| 6,866,401 | B2 * | 3/2005 | Sommers | F21V 5/006 362/169 |
| 2011/0063836 | A1 * | 3/2011 | Salm | G02B 27/0961 362/235 |
| 2013/0293148 | A1 * | 11/2013 | Holland | F21V 5/04 315/297 |

* cited by examiner

*Primary Examiner* — Robert May

(57) ABSTRACT

A focusing structure for an LED lamp is provided. LED chips are provided in a main body of the LED lamp, a front end of the main body 1 is provided with a lens assembly. At least one of the LED chips 2 is not located on the axis of the LED lamp, and at least two groups of lenses with different degrees are provided on the lens assembly, the location of each group of lenses corresponding to a corresponding LED chip on the same circumference, and the lens assembly is connected to the main body with structures capable of relatively rotating and snap-fitting. The LED lamp can achieve the focusing function by rotating the lenses assembly to make the lenses with different degrees correspond to the LED chips. This structure has no light loss and can achieve the focusing function of various focal distances.

5 Claims, 12 Drawing Sheets

FOCUSING STRUCTURE FOR LED LAMP HAVING A LENS ASSEMBLY ROTATABLY ENGAGED TO A MAIN BODY

BACKGROUND OF THE INVENTION

1. Field of the Invention

The present invention relates to an LED lamp, and more particularly to a focusing structure for an LED lamp.

2. Description of the Prior Art

An LED lamp comprises LED chips and lenses in front of the LED chips so as to focus the light. FIG. 1 is an exploded view of a conventional LED lamp. The LED lamp comprises a main body 1', LED chips 2' mounted in the main body 1', and a lens assembly 3' mounted at the front end of the main body 1'. This kind of LED lamp is unable to adjust focus. If the user wants to change the angle of illumination, it is necessary to replace with lenses with different angles. However, it is very inconvenient to replace the lenses when in use.

An improved LED lamp on the market can adjust its brightness and illuminating range. Chinese Utility Model Publication No. CN202065923U published on Dec. 7, 2011 discloses a light adjustment structure of an LED lamp. This LED lamp is like the conventional LED lamp able to adjust focus. The angle of illumination can be changed by changing the distance between the lenses and the chips. This way causes light loss to influence the illumination effect. Accordingly, the inventor of the present invention has devoted himself based on his many years of practical experiences to solve these problems.

SUMMARY OF THE INVENTION

The primary object of the present invention is to provide a focusing structure for an LED lamp, which can decrease light loss and adjust focus.

In order to achieve the aforesaid object, the focusing structure of the present invention comprises a main body, LED chips mounted in the main body and a lens assembly mounted at a front end of the main body. At least one of the LED chips is not located on the axis of the LED lamp. The lens assembly comprises at least two sets of lenses with different degrees. Each set of lenses correspond in position to the LED chips at the same circumference. The lens assembly and the main body are rotatably engaged with each other.

Preferably, the main body has a chamber therein. The inner wall of the chamber has positioning grooves. The number of the positioning grooves is a multiple of the number of the lenses. The lens assembly further comprises a fixing disc for mounting the lenses. The fixing disc has at least one positioning post thereon. After the lens assembly is inserted in the chamber of the main body, the positioning post will engage with a corresponding one of the is positioning grooves so that the lens assembly is mated with the chamber tightly.

Preferably, the fixing disc has a notch, and the main body has a lens degree indicator corresponding in position to the notch.

Preferably, the positioning grooves are disposed on vertical ribs of the inner wall of the chamber of the main body, the fixing disc of the lens assembly is provided with a plurality of spaced bosses, and the positioning post is disposed on the bosses.

Preferably, the main body has at least one positioning post thereon. The lens assembly further comprises a fixing disc for mounting the lenses. The fixing disc has positioning grooves thereon. The number of the positioning grooves is a multiple of the number of the lenses. The fixing disc of the lens assembly has an engaging hook thereon, and a boss is provided in the chamber of the main body to mate with the engaging hook.

Preferably, the fixing disc has a lens degree indicator disposed beside the positioning grooves.

Preferably, one of the LED chips is located on the axis of the LED lamp. The lens assembly has one lens corresponding to the LED chip on the axis of the LED lamp, and the degree of the lens corresponding to the LED chip on the axis of the LED lamp is the same as or different from that of the other lenses.

The lens assembly of the present invention comprises a plurality of sets of lenses with different angles. When in use, the lens assembly is rotated for the lenses to align with the LED chips to achieve focus adjustment function. This structure changes the distance between the chips and the lenses for adjusting focus so there is no light loss to ensure illumination effect and to achieve various is focus adjustment functions.

DETAILED DESCRIPTION OF THE PREFERRED EMBODIMENTS

Figure 1:
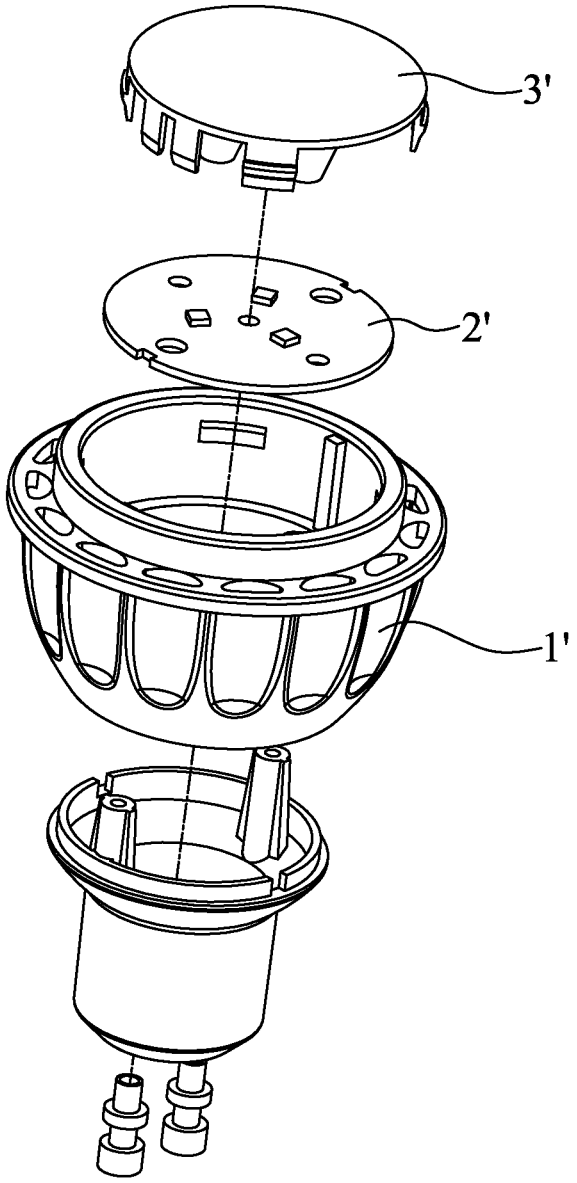
F I G. 1 Prior Art
FIG. 1 is an exploded view of a conventional LED lamp.
Figure 2:
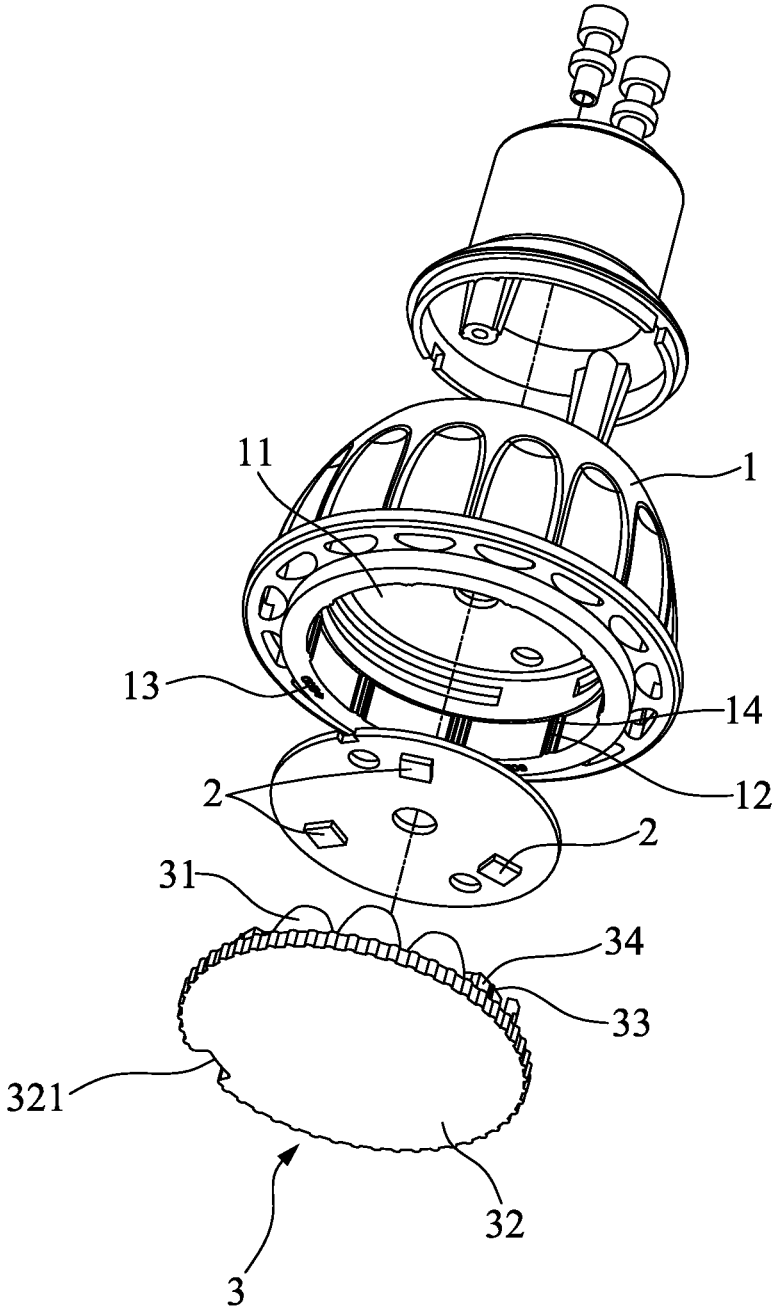
FIG. 2 is an exploded view of a first embodiment of the present invention.

Embodiments of the present invention will now be described, by way of example only, with reference to the accompanying drawings.

The present invention discloses a focusing structure for an LED lamp. As shown in FIG. 2 to FIG. 6, a first embodiment of the present invention comprises a main body 1, an LED chip 2 mounted in the main body 1, and a lens assembly 3 mounted at the front end of the main body 1. The LED chip 2 may be one, two or more according to the demand. This embodiment has three LED chips 2. The three LED chips 2 are located at the same circumference.

The lens assembly 3 comprises at least two sets of lenses 31 with different degrees. Each set of lenses 31 corresponds in position to the LED chips 2 at the same circumference. This embodiment has two sets of lenses 31. One set of lenses 311 is 20 degrees, and the other set of lenses 312 is 40 degrees. In this embodiment, the three LED chips 2 are evenly arranged at the same circumference. Each set of lenses 31 has three lenses, namely, the two sets of lenses have six lenses 31. The six lenses 31 are evenly arranged at the same circumference corresponding to the LED chips 2. The two sets of lenses are spaced. The lens assembly 3 and the main body 1 are rotatably engaged with each other.

Furthermore, the connection of the lens assembly 3 and the main body 1 is described hereinafter. The main body 1 has a chamber 11. The inner wall of the chamber 11 has at least two positioning grooves 12. The number of the positioning grooves 12 is a multiple of the number of the lenses. The lens assembly 3 further comprises a fixing disc 32 for mounting the lenses 31. The fixing disc 32 has at least one positioning post 33 thereon. There is no need to limit the number of the positioning post 33, one or equal to the number of the positioning grooves 12. In this embodiment, the number of the positioning posts 33 is equal to the number of the positioning grooves 12. After the lens assembly 3 is inserted in the chamber 11 of the main body 1, the positioning post 33 will engage with the positioning groove 12, so that the lens assembly 3 is mated with the chamber 11 tightly.

Besides, the fixing disc 32 has a notch 321. The main body 1 has a lens degree indicator 13 corresponding in position to the notch 321.

Figure 3:
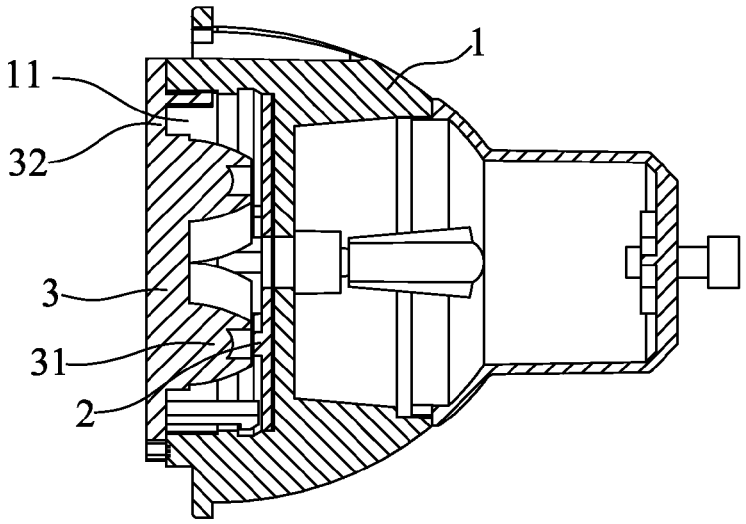
FIG. 3 is a sectional view of the first embodiment of the present invention (the focus is adjusted to 20 degrees)
Figure 4:
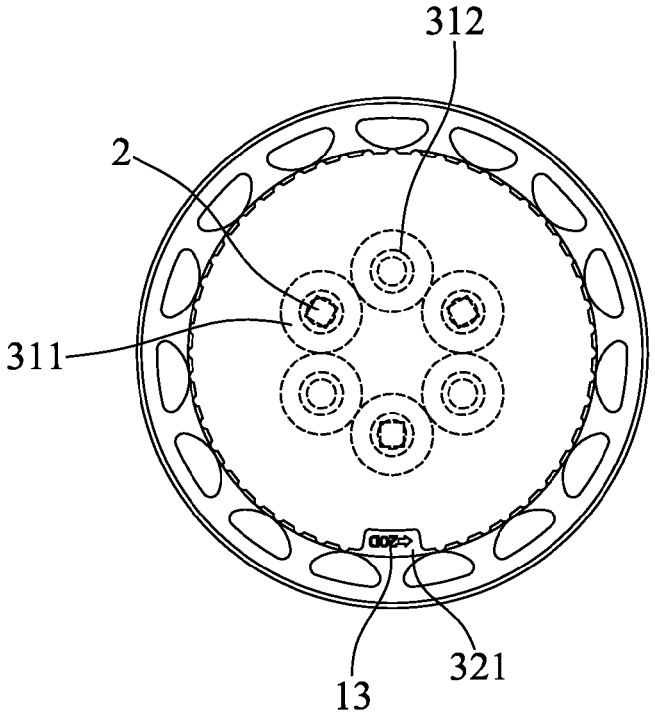
FIG. 4 is a front view of the first embodiment of the present invention (the focus is adjusted to 20 degrees)

To focus the LED lamp, as shown in FIG. 3 and FIG. 4, if the initial state is 20 degrees, namely, the three 20 degree lenses 311 are aligned with the three LED chips 2. When the user wants to make an adjustment from 20 degrees to 40 degrees, according to the direction of the arrow, the lens assembly 3 is direct rotated for the positioning post 33 to disengage from the positioning groove 12 until the positioning post 33 engages with the next positioning groove 12 and the 40 degree lenses 312 are aligned with the LED chips 2.

Figure 5:
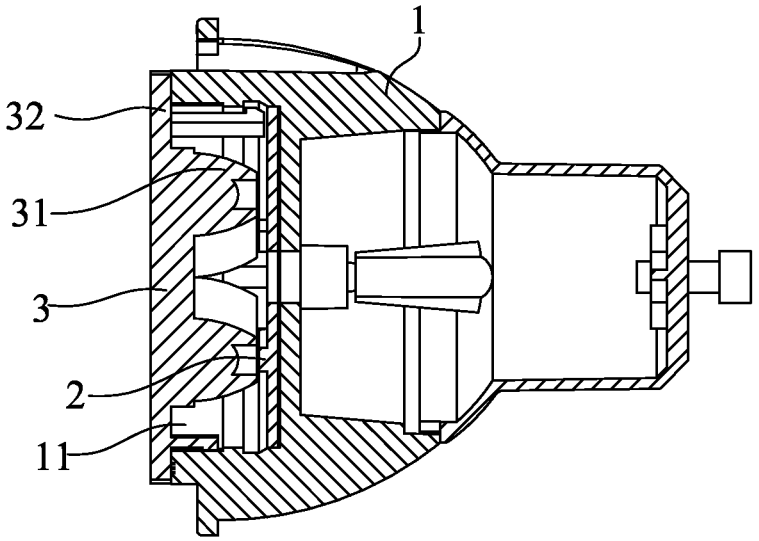
FIG. 5 is a sectional view of the first embodiment of the present invention (the focus is adjusted to 40 degrees)
Figure 6:
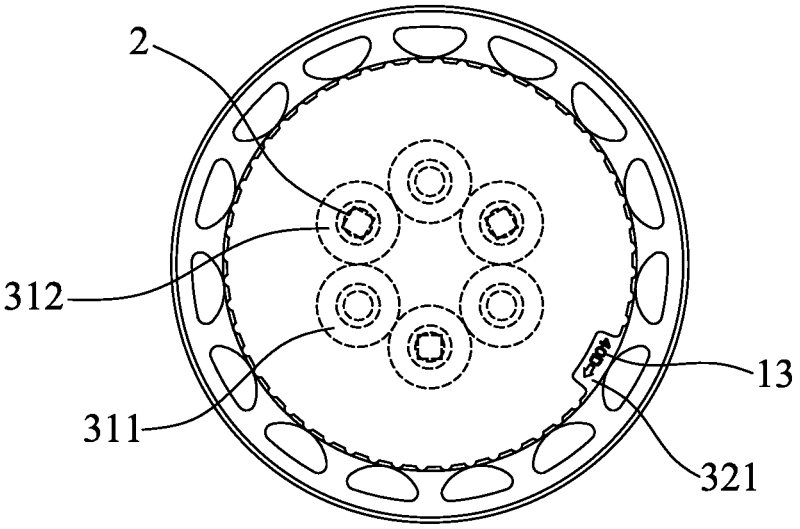
FIG. 6 is a front view of the first embodiment of the present invention (the focus is adjusted to 40 degrees)

As shown in FIG. 5 and FIG. 6, when the user wants to make an adjustment from 40 degrees to 20 degrees, the aforesaid operation is repeated. During rotation, the user can know whether the adjustment is in place by means of the arrow on the lens assembly 3 or the main body 1, alternatively, by means of the lens degree indicator 13 of the main body 1 underneath the notch 321 of the lens assembly 3.

As shown in FIG. 7 to FIG. 12, a second embodiment of the present invention is substantially similar to the first embodiment with the exceptions described hereinafter. The second embodiment has three sets of lenses 31, namely, three 20 degree lenses 311, three 40 degree lenses 312 and three 60 degree lenses 313. The nine lenses 31 are evenly arranged at the same circumference corresponding to the LED chips 2. The three sets of lenses are spaced. In this embodiment, the LED lamp has three focal lengths for adjustment. In the drawings, the numerical members of the second embodiment are the same as the first embodiment, and won't be described in detail.

Figure 7:
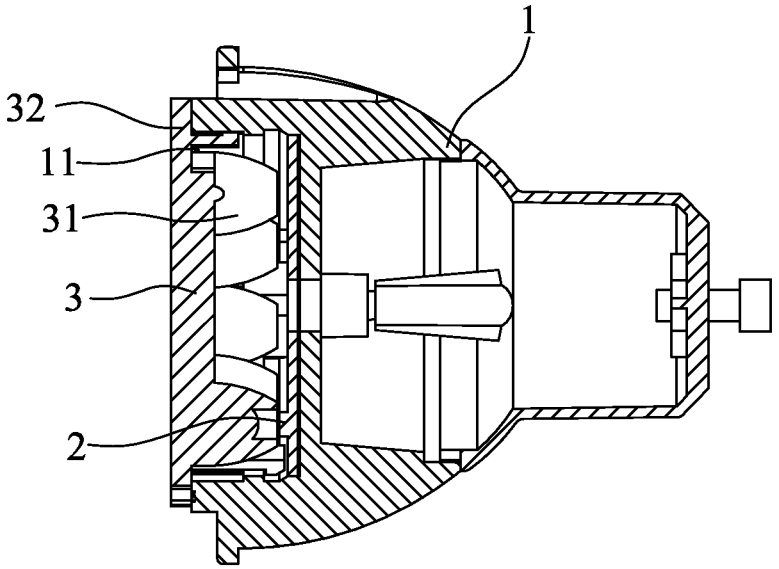
FIG. 7 is a sectional view of a second embodiment of the present invention (the focus is adjusted to 20 degrees)
Figure 8:
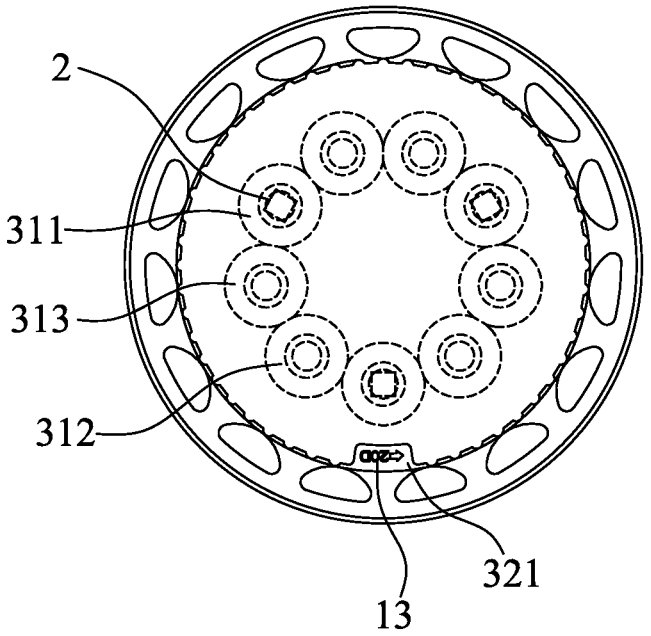
FIG. 8 is a front view of the second embodiment of the present invention (the focus is adjusted to 20 degrees)

Similarly, as shown in FIG. 7 and FIG. 8, when the user wants to make an adjustment from 20 degrees to 40 degrees, according to the direction of the arrow of the lens degree indicator 13 on the main body 1, the lens assembly 3 is rotated for the positioning post 33 to disengage from the positioning groove 12 until the positioning post 33 engages with the next positioning groove 12 and the 40 degree lenses 312 are aligned with the LED chips 2.

Figure 9:
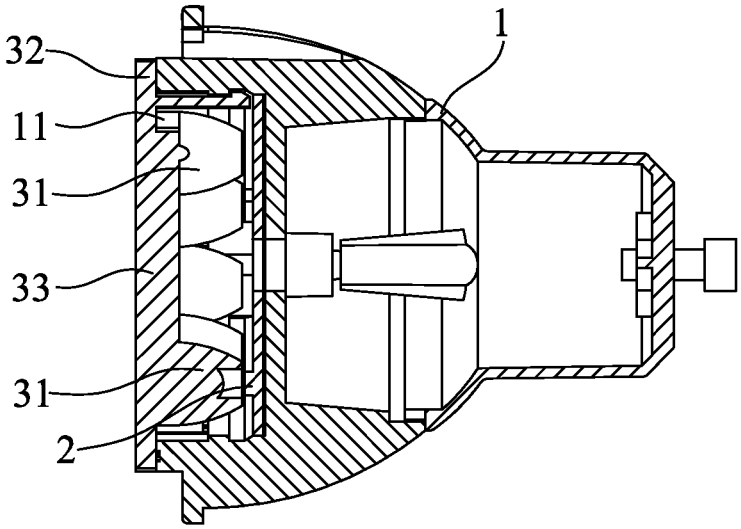
FIG. 9 is a sectional view of the second embodiment of the present invention (the focus is adjusted to 40 degrees)
Figure 10:
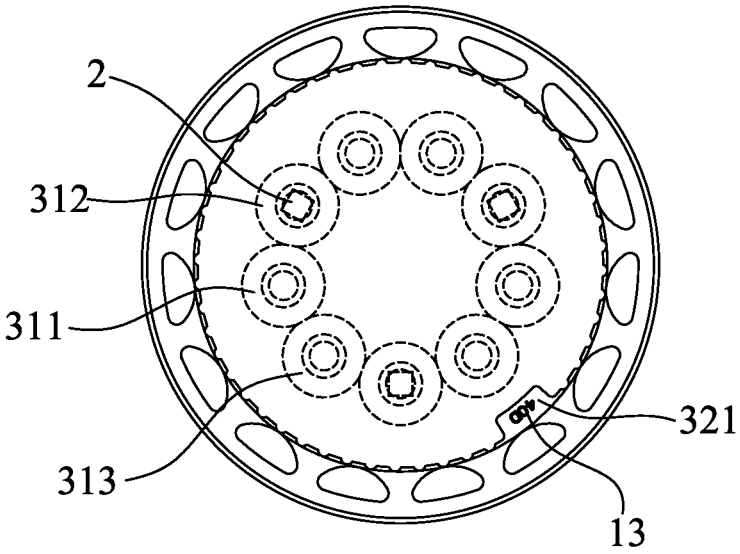
FIG. 10 is a front view of the second embodiment of the present invention (the focus is adjusted to 40 degrees)
Figure 11:
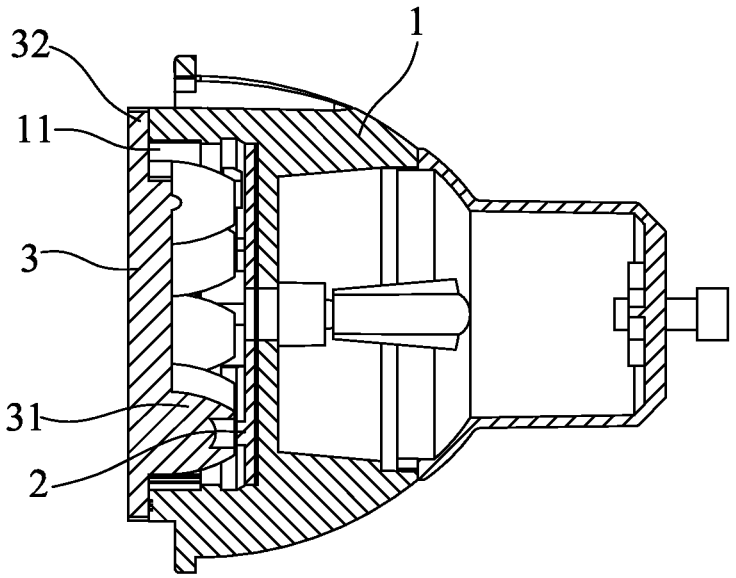
FIG. 11 is a sectional view of the second embodiment of the present invention (the focus is adjusted to 60 degrees)
Figure 12:
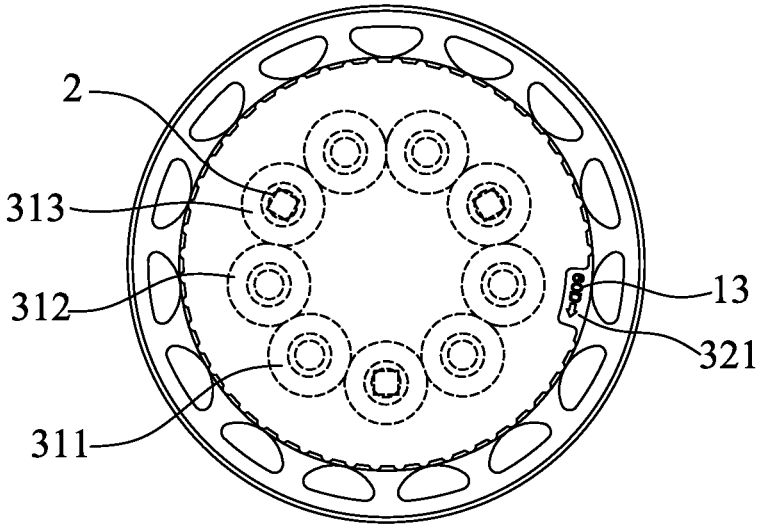
FIG. 12 is a front view of the second embodiment of the present invention (the is focus is adjusted to 60 degrees)

As shown in FIG. 9 and FIG. 10, when the user wants to make an adjustment from 40 degrees to 60 degrees, according to the direction of the arrow of the lens degree indicator 13 on the main body 1, the lens assembly 3 is rotated for the positioning post 33 to disengage from the positioning groove 12 until the positioning post 33 engages with the next positioning groove 12 and the 60 degree lenses 313 are aligned with the LED chips 2 (as shown in FIG. 11 and FIG. 12).

In the aforesaid embodiment, the positioning post 33 engages with the positioning groove 12, so that the lens assembly 3 is mated with the chamber 11 of the main body 1 tightly. Thus, the lens assembly 3 is secured in the chamber 11, preventing the lens assembly 3 from disengaging from the main body 1. The size of the positioning post 33 is slightly less than the positioning groove 12. By applying a force slightly to rotate the lens assembly 3, the positioning post 33 can disengage from the positioning groove 12. If the lens assembly 3 is too tight to rotate, the user can pull out the lens assembly 3 from the main body 1 and then choose the desired lenses to align with the LED chips 2 so as to adjust focus.

For the lens assembly 3 to be rotated smoothly when the positioning posts 33 are not mated with the positioning groove 12, the positioning grooves 12 may be disposed on vertical ribs 14 of the inner wall of the chamber 11 of the main body 1. The fixing disc 32 of the lens assembly 3 is provided with a plurality of spaced bosses 34. The positioning posts 33 are disposed on the bosses 34. When the positing posts 33 disengage from the positioning grooves 12, the bosses 34 are staggered relative to the vertical ribs 14, so that the lens assembly 3 is not tightly mated with the chamber 11 of the main body 1 to be rotated smoothly for focus.

As shown in FIG. 13 to FIG. 20, a third embodiment of the present invention is substantially similar to the first and second embodiments with the exceptions described hereinafter. The LED chips 2 of the aforesaid two embodiments are flat chips. In the third embodiment, the LED chips 2 are semi-spherical chips. The bottom of the lens 31 has a recess 35 for the semi-spherical LED chip 2 to gather light. The semi-spherical LED chip 2 can be inserted in the recess 35. In this structure, the lens assembly 3 is unable to rotate at will. In order to achieve this problem, this embodiment is improved.

In the third embodiment, the LED lamp also comprises the LED chips 2 mounted in the main body 1. The lens assembly 3 is mounted at the front end of the main body 1. This embodiment has three LED chips 2. The difference of this embodiment is that the LED chips 2 are semi-spherical chips. Similarly, the lens assembly 3 has at least two sets of lenses 31 with different degrees. The bottom of each lens 31 of this embodiment has a recess 35. Each set of lenses 31 corresponds in position to the LED chips 2. This embodiment has three sets of lenses 31, namely, three 20 degree lenses 311, three 40 degree lenses 312 and three 60 degree lenses 313. The lens assembly 3 and the main body 1 are rotatably engaged with each other.

Furthermore, the connection of the lens assembly 3 and the main body 1 is described hereinafter. The main body 1 has at least one positioning post 15 thereon. The lens assembly 3 further comprises a fixing disc 32 for mounting the lenses 31. The fixing disc 32 has at least two positioning grooves 36 thereon. The number of the positioning grooves 36 is a multiple of the number of the lenses. In this embodiment, the number of the positioning posts 15 is equal to the number of the positioning grooves 36. In addition, the fixing disc 32 of the lens assembly 3 has an engaging hook 37 thereon. A boss 16 is provided in the chamber 11 of the main body 1 to mate with the engaging hook 37. After the lens assembly 3 is inserted in the chamber 11 of the main body 1, one of the positioning grooves 36 will engage with the positioning post 15 of the main body 1. The engaging hook 37 extends into the interior of the boss 16 of the main body 1 to prevent the lens assembly 3 from disengaging from the chamber 11. The lens assembly 3 can be moved up and down in the axial direction.

Furthermore, the fixing disc 32 is provided with a lens degree indicator 38 at a proper position.

Figure 13:
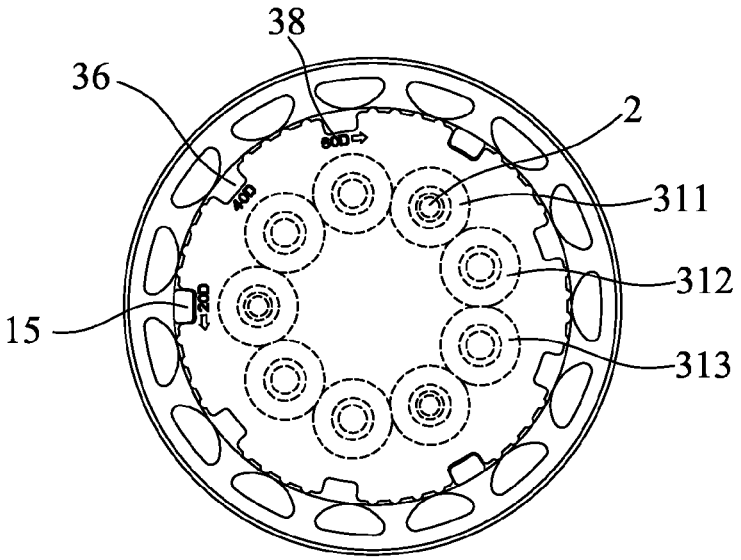
FIG. 13 is a front view of a third embodiment of the present invention (located at 20 degrees)
Figure 14:
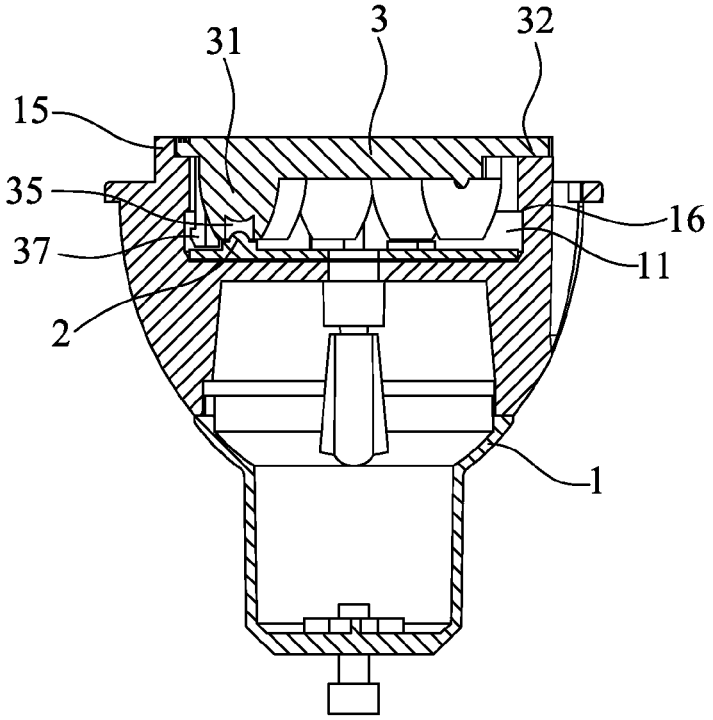
FIG. 14 is a sectional view of the third embodiment of the present invention (located at 20 degrees)
Figure 15:
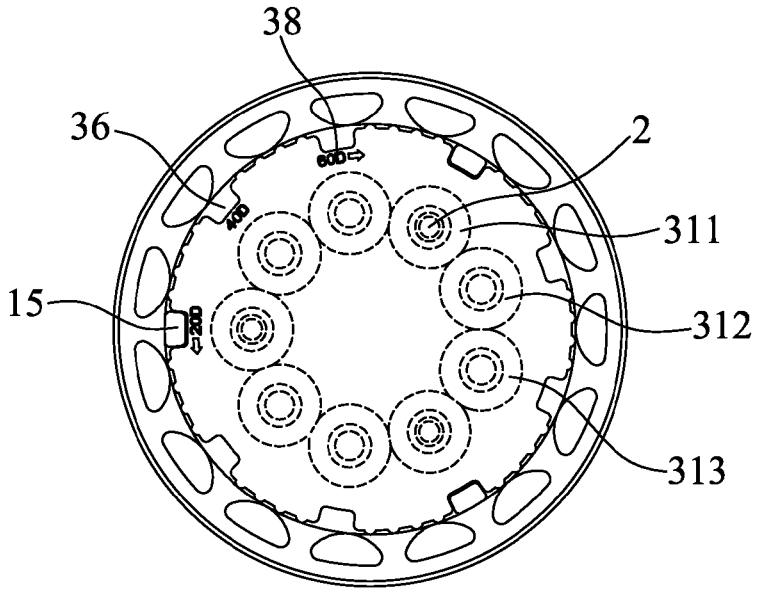
FIG. 15 is a schematic view showing the focus adjustment of the third embodiment of the present invention (front view)
Figure 16:
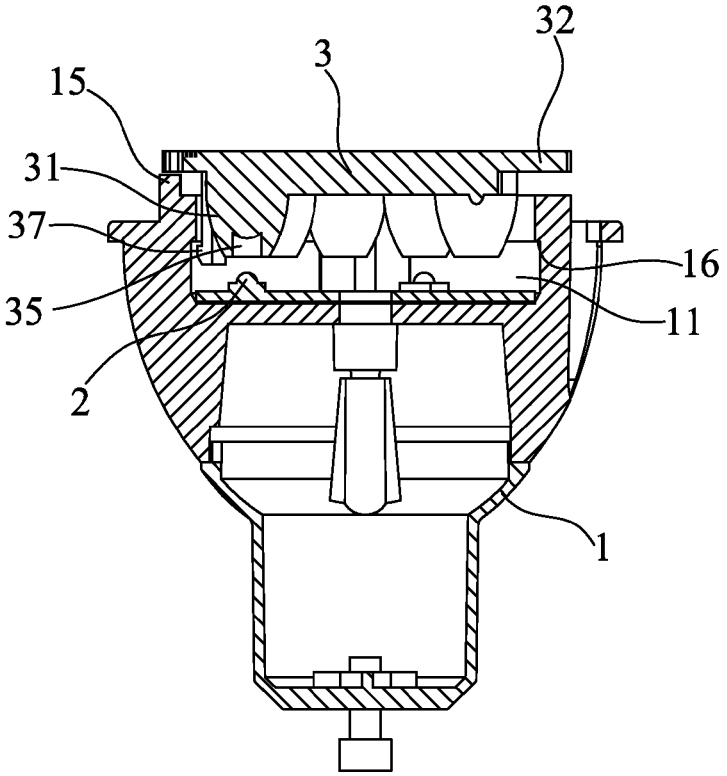
FIG. 16 is a schematic view showing the focus adjustment of the third embodiment of the present invention (sectional view)
Figure 17:
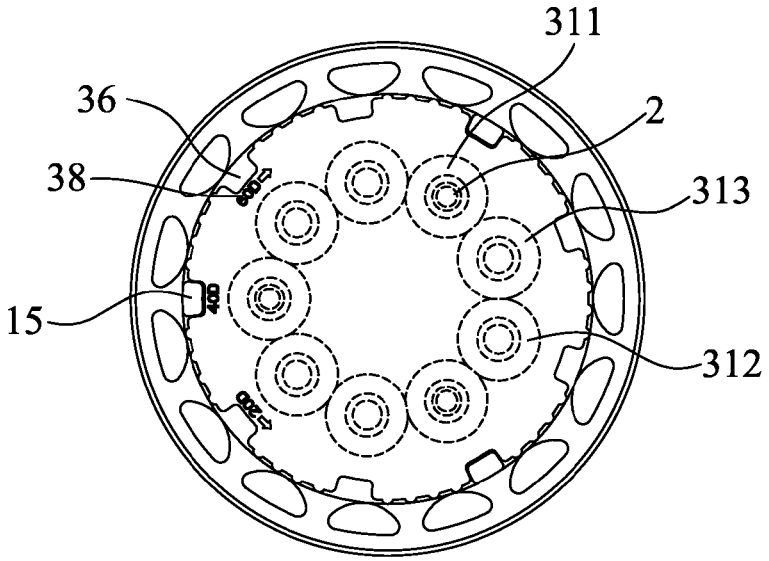
FIG. 17 is another schematic view showing the focus adjustment of the third embodiment of the present invention (front view)
Figure 18:
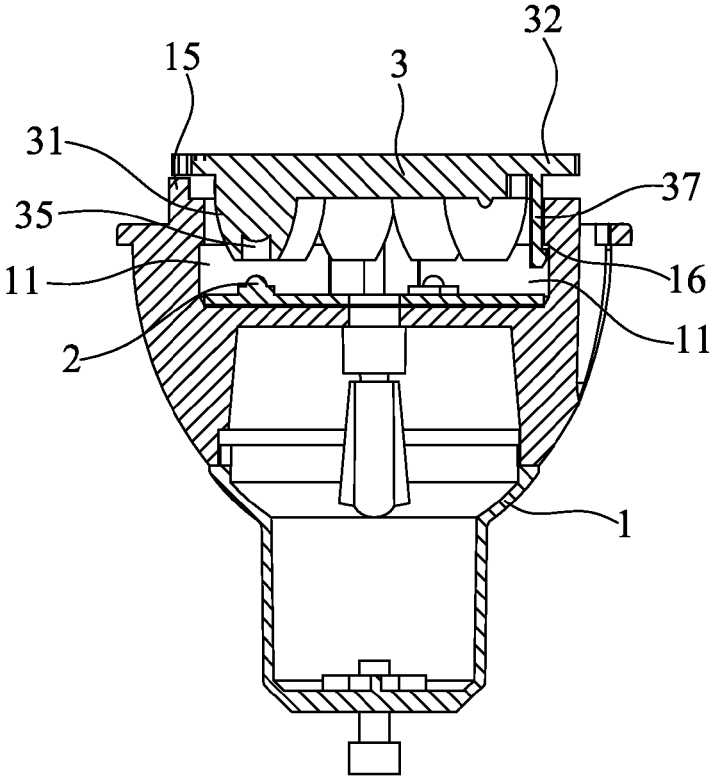
FIG. 18 is another schematic view showing the focus adjustment of the third embodiment of the present invention (sectional view)

To focus the LED lamp, as shown in FIG. 13 and FIG. 14, if the initial state is 20 degrees, namely, the three 20 degree lenses 311 are aligned with the three LED chips 2. When the user wants to make an adjustment from 20 degrees to 40 degrees, the lens assembly 3 is first pulled outward for the recesses 35 of the lenses 31 to disengage from the semi-spherical LED chips 2 and the positioning post 15 to disengage from the positioning groove 36, as shown in FIG. 15 and FIG. 16. After that, the lens assembly 3 is rotated until the positioning post 15 and the positioning groove 36 are at the same vertical plane, as shown in FIG. 17 and FIG. 18. The lens assembly 3 is then pushed down for engagement.

Figure 19:
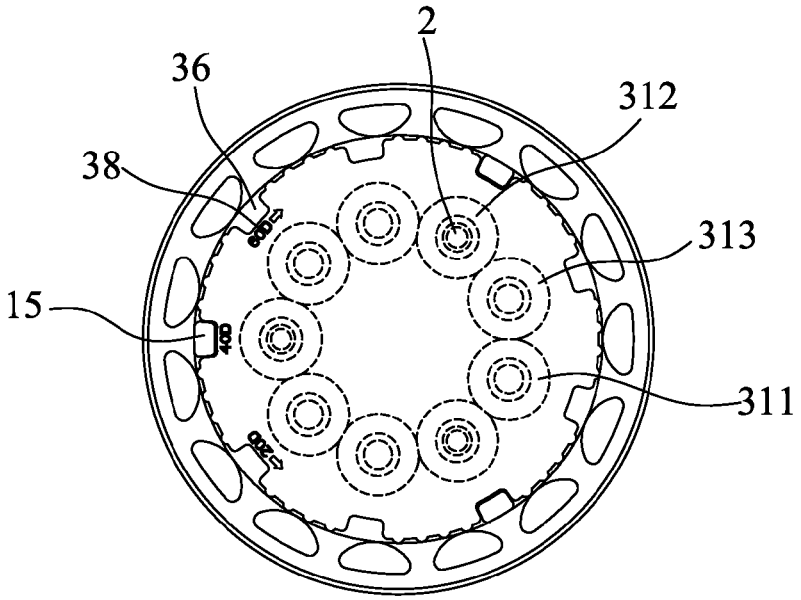
FIG. 19 is a front view of the third embodiment of the present invention (the focus is adjusted to 40 degrees)
Figure 20:
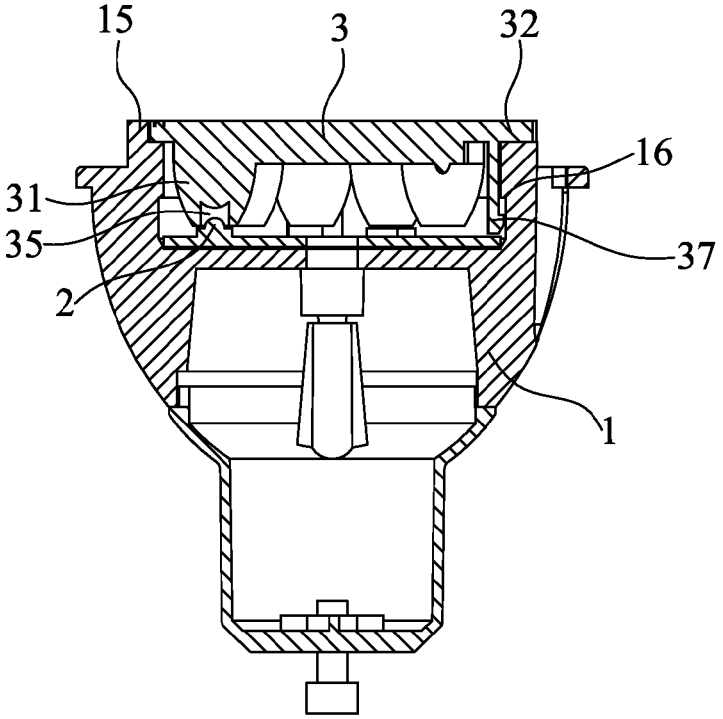
FIG. 20 is a sectional view of the third embodiment of the present invention (the focus is adjusted to 40 degrees)

Thus, the 40 degree lenses 312 are aligned with the LED chips 2, as shown in FIG. 19 and FIG. 20.

When the user wants to make another degree adjustment, the aforesaid operation is repeated. During rotation, the user can know whether the adjustment is in place by means of the lens degree indicator 38 disposed beside the positioning groove 36 to mate the lens with the chip for an adjustment as desired.

The size of the positioning post 15 and the positioning groove 36 of this embodiment is greater than that of the positioning post 33 and the positioning groove 12 of the aforesaid two embodiments. When the lens assembly 3 is not pulled outward, the lens assembly 3 cannot be rotated by means of cooperation of the positioning post 15 and the positioning groove 36. This way can prevent the semi-spherical LED chip 2 to collide with the recess 35 to damage the LED chip.

Figure 21:
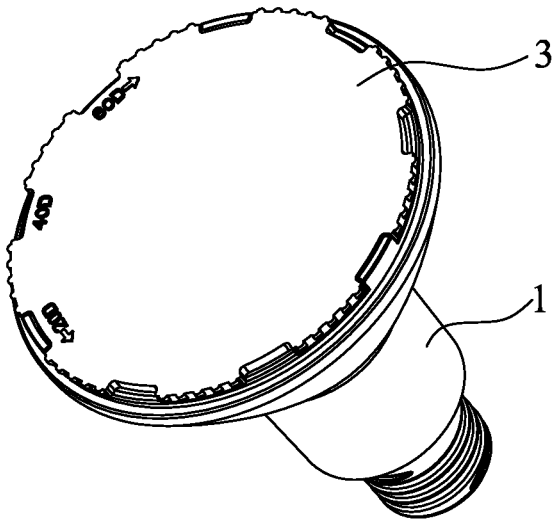
FIG. 21 is a perspective view of a fourth embodiment of the present invention.
Figure 22:
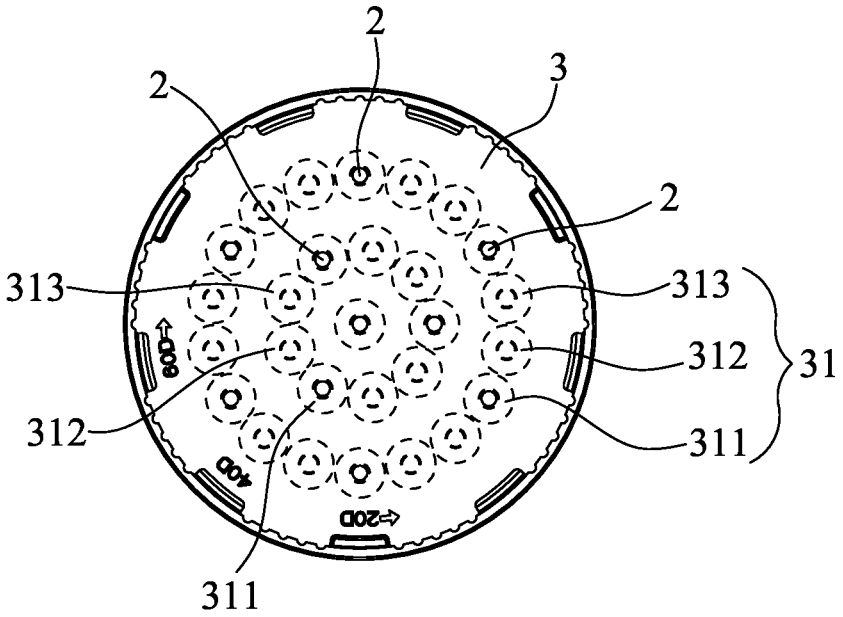
FIG. 22 is a top view of the fourth embodiment of the present invention.

As shown in FIG. 21 and FIG. 22, a fourth embodiment of the present invention is substantially similar to the aforesaid embodiments with the exceptions described hereinafter. This embodiment has ten LED chips 2. One is disposed on the axis of the lamp, and the others are divided into two sets evenly disposed at two concentric circumferences. Three LED chips are disposed around the small circumference, and six LED chips are disposed around the big circumference. Except the lens corresponding to the central chip 2, this embodiment has three sets (two sets or more) of lenses 31 with different degrees, namely, three 20 degree lenses 311, three 40 degree lenses 312 and three 60 degree lenses 313. The three lenses 311, 312, 313 of each set correspond in position to the corresponding LED chips 2 at the same circumference. In this embodiment, the lens assembly 3 is rotated for the lenses 31 of each set to be aligned with the corresponding LED chips 2 to adjust focus. The lens assembly 3 and the main body 1 are rotatably engaged with each other, like the aforesaid embodiments.

The number and position of the LED chips 2 according to the aforesaid four embodiments can be changed as desired, but the central LED chip 2 cannot play a part in adjustment. That is to say, when the LED lamp has one LED chip, the chip cannot be disposed on the axis of the lamp. For the lamp having the LED chip on the axis, the corresponding lens cannot play a part in adjustment. Thus, the degree depends on the demand as desired. The central chip is to make up the central lightness.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A focusing structure for an LED lamp, comprising
a main body,
LED chips mounted in the main body, and
a lens assembly mounted at a front end of the main body,
at least one of the LED chips being not located on the axis of the LED lamp,
the lens assembly comprising at least two sets of lenses,
each set of lenses corresponding in position to the LED chips on a same circumference,
the lens assembly and the main body being rotatably engaged with each other,
wherein the main body has a chamber therein, an inner wall of the chamber has positioning grooves, the number of the positioning grooves is a multiple of the number of the lenses, the lens assembly further comprises a fixing disc for mounting the lenses, the fixing disc has at least one positioning post thereon, after the lens assembly is inserted in the chamber of the main body, the at least one positioning post engages with a corresponding one of the positioning grooves so that the lens assembly is mated with the chamber tightly.

2. The focus adjustment structure of an LED lamp as claimed in claim 1, wherein the fixing disc has a notch, and the main body has a lens degree indicator corresponding in position to the notch.

3. The focusing structure for an LED lamp as claimed in claim 1 or 2, wherein the positioning grooves are disposed on vertical ribs of the inner wall of the chamber of the main body, the fixing disc of the lens assembly is provided with a plurality of spaced bosses, and the at least one positioning post is disposed on the bosses.

4. The focusing structure for an LED lamp as claimed in claim 1, wherein the main body has at least one positioning post thereon, the lens assembly further comprises a fixing disc for mounting the lenses, the fixing disc has positioning grooves thereon, the number of the positioning grooves is a multiple of the number of the lenses, the fixing disc of the lens assembly has an engaging hook thereon, and a boss is provided in the chamber of the main body to mate with the engaging hook.

5. The focusing structure for an LED lamp as claimed in claim 4, wherein the fixing disc has a lens degree indicator disposed beside the positioning grooves.

* * * * *